United States Patent [19]

Koelichen et al.

[11] 4,280,277

[45] Jul. 28, 1981

[54] INSCRIPTION INSTRUMENT

[75] Inventors: Harald Koelichen, Geretsried; Adolf Deutsch, Königsdorf, both of Fed. Rep. of Germany

[73] Assignee: Standardgraph Filler & Fiebig GmbH, Fed. Rep. of Germany

[21] Appl. No.: 130,962

[22] Filed: Mar. 17, 1980

[30] Foreign Application Priority Data

Apr. 25, 1979 [DE] Fed. Rep. of Germany ..... 2916731

[51] Int. Cl.[3] ..... B43L 13/10

[52] U.S. Cl. ..... 33/23 D

[58] Field of Search ..... 33/23 D; D19/41; 401/48

[56] References Cited

U.S. PATENT DOCUMENTS

| | | | |
|---|---|---|---|
| 2,616,179 | 11/1952 | Anderson | 33/23 D |
| 2,748,474 | 6/1956 | Brown | 33/18 R |
| 2,809,432 | 10/1957 | Waddle | 33/23 D |
| 4,095,906 | 6/1978 | Sackett | D19/41 X |

*Primary Examiner*—Harry N. Haroian

*Attorney, Agent, or Firm*—Ostrolenk, Faber, Gerb & Soffen

[57] ABSTRACT

The disclosure concerns a stencil sensing inscription instrument. The instrument includes a writing arm having a writing implementation at one end and a tracing pin at the other end for insertion in a guide groove. A separate sensing arm is rotatable to a plurality of positions with respect to the writing arm and can be clamped in any of the positions. The sensing arm carries a sensing pin for sensing characters in a stencil. Between the sensing arm and the writing arm clamped connection, on the one hand, and the tracing pin on the other hand, a manual grip is defined. The sensing arm also carries a manual grip.

10 Claims, 4 Drawing Figures

INSCRIPTION INSTRUMENT

The invention relates to an inscription instrument of the type comprising a writing arm which has a writing implement at one end and a tracing pin at the other end which can be inserted into a guide groove. Furthermore, a sensing arm is provided. It is adapted to be fixed with respect to the writing arm in a plurality of relative positions. It includes a sensing pin for sensing the characters in a stencil. Such inscription instruments are used in conjunction with grooved patterns or stencils and a support rail with guide groove for the track pin in order to transfer letters, numbers, characters or symbols disposed on the pattern or stencil to a drawing paper; By adjusting the sensing arm with respect to the writing arm the lettering form, size and location may be varied as desired while using only a single stencil. A further advantage compared with drawing stencils provided with holes, in the cutouts of which the writing implement is inserted directly, is that such characters as "8" or "B" may be drawn in one stroke while with drawing stencils they require two drawing operations. Moreover, such inscription instruments avoid the problem of stencils being dissolved by inks.

In a known lettering or inscription instrument of this type the writing arm carries a bearing pin on which the sensing arm is mounted with a slot guide. A clamping nut can be screwed on to the pivot pin so that the sensing arm can be fixed in any possible relative position with respect to the writing arm.

In such lettering instruments the adjustment knob served simultaneously as grip during scanning of the pattern grooves. Although satisfactory inscription is possible with such instruments, when writing for longer periods, fatigue effects occurred due to a certain cramping of the hand after writing for longer periods. Furthermore, for an unskilled operator it was frequently found disadvantageous that the guide grip formed by the clamping nut was relatively far from the sensing or scanning pin because this could result in jerky sensing or tracing.

The invention is thus based on the problem of improving an inscription instrument of the type mentioned at the beginning, retaining full function and combination possibilities, so that effortless cramp-free operation is possible even for lengthy periods.

The problem is solved by the writing arm being shaped as a grip body at the rear portion of the writing arm between the clamping head and the tracing pin. As a result, the inscription instrument lies loosely in the hand of the user and the fingers can comfortably grip the instrument, which is thus for the first time made satisfactorily from the ergonometric point of view.

A particularly favourable handling results if in accordance with the preferred embodiment a guide grip is provided for the thumb and index finger on the sensing arm itself instead of fixed on the writing arm as hitherto. According to the preferred embodiment in the following description the guide grip is mounted substantially in the center portion of the sensing arm and pivotally on the latter and is formed as flat grip member with grip recesses so that the guide grip can be easily held and rapidly guided without effort. The guide of the inscription instrument is thus moved closer to the sensing or tracing pin so that rapid tracing of the pattern grooves is possible. A further simplification in handling is obtained with the preferred embodiment in which the lower portion of the grip body comprises a finger grip recess in which the ring finger or possibly also the little finger can engage in order to raise the instrument effortlessly from the drawing surface. This makes it possible to hold the instrument with one hand and without changing the hand position is set the instrument down, guide it and raise it again. The instrument lies in the hand comfortably without any necessity of exerting large forces via the thumb and index finger for holding and guiding.

Due to the shaping developed from ergonometric points of view even after lengthy periods of use effortless easy actuation is possible. The guide grip facilitates tracing of the letters, numbers and characters in the lettering pattern. Further advantageous developments of the invention relate inter alia to steps by which the lettering form and size can be adjusted in simple and infinitely variable manner by means of a scale. One and the same style may be written inclined to the left, right, or vertical or at any desired inclination.

Hereinafter an embodiment of the invention will be explained with the aid of the drawings, wherein.

Figure 1:
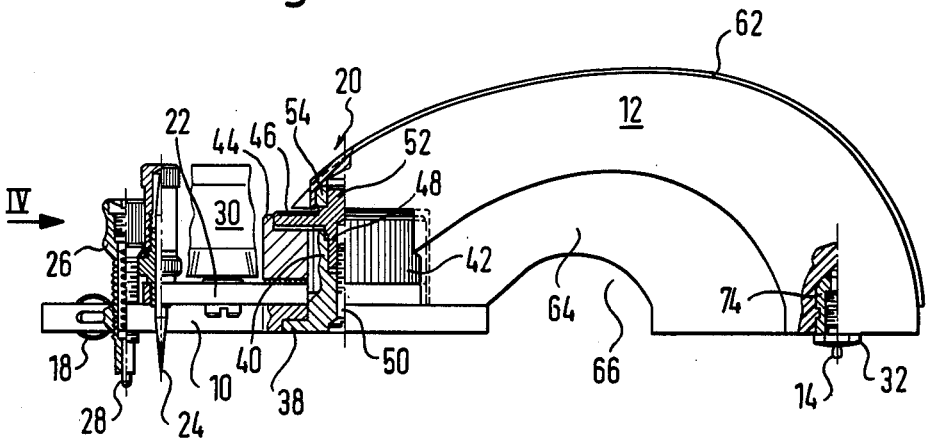
FIG. 1 is a side view of the inscription instrument according to the invention, partially in section.
Figure 4:
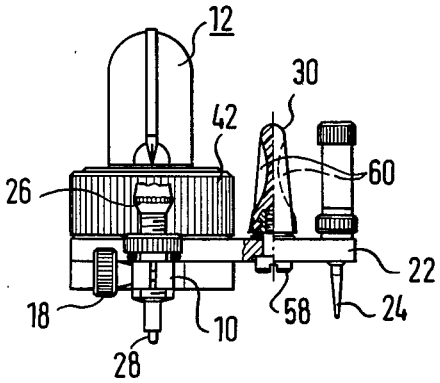
FIG. 4 is an end elevation of the inscription instrument according to FIG. 1 in the direction of the arrow IV of FIG. 1.

The lettering instrument comprises a writing arm 10 which continues rearwardly in a grip body 12 which carries the tracing pin 14. The writing arm 10 carries at its free end an ink filling insert 16 into which a writing insert can be clamped by means of a clamping screw 18. Disposed in the portion joining the writing arm 10 to the grip body 12 is a clamping head 20 with which a sensing arm 22 can be clamped in various relative positions with respect to the writing arm 10. The sensing arm 22 carries a sensing pin 24 which can be inserted into the inset characters of a stencil sheet and traces said characters. The writing arm 10 carries a vertical adjuster 26 having a resiliently mounted support pin 28 which defines the vertical position above the drawing plane and after release of the instrument via the resilient support pin raises said instrument from the drawing surface. The sensing arm 22 carries a guide grip 30 which can be gripped with thumb and index finger. The tracing pin 14 comprises an hexagonal head 32 with which it can be screwed out of the threaded bore of the grip body and screwed into another threaded bore of said body.

The writing arm 10 is secured by means of a screw 34 rigidly on the grip body 12. It comprises an eye 36 into which a threaded sleeve 40 provided with head flange 38 projects on the outer thread of which a knurled nut 42 is screwed. Said nut comprises in its upper side a recess which is surrounded by an annular flange 44 and in which a scale carrier disc 46 lies. The latter projects with a lower sleeve extension 48 into the hollow interior of the threaded sleeve 40 and is non-rotatably connected to the latter via key faces. Via a screw 50 the threaded sleeve 40 is clamped to the scale carrier disc. An upwardly projecting pin 52 of the scale carrier disc projects into a bushing 54 of the grip body and is rotatable therein. By tightening the knurled nut 42 on the threaded sleeve 40 the sensing arm 22 may be clamped with respect to the writing arm in any relative angular position. According to the embodiment illustrated only pivoting of the sensing arm 22 with respect to the writing arm 10 is provided but according to a modified embodiment the sensing arm may also be arranged displaceably with respect to the writing arm via a slot guide so that the length of the sensing arm is adjustable, providing further possibilities as regards lettering size and position.

The grip body 12 comprises in the region of the clamping head 20 a notch 56 against which the scale of the scale carrier disc 46 can be read. If the sensing arm is non-rotatably connected to the threaded sleeve 40 and the scale carrier disc 46, the angular position of the sensing arm with respect to the writing arm can be read from said notch 56. Alternatively, the scale carrier disc may be disposed fixed and the sensing arm provided with a marking which can be read against said fixed scale.

The guide grip 30 is mounted on the sensing arm 22 by means of a screw 58 and the grip is rotatable with respect to the arm. It comprises shallow grip recesses 60 permitting sensitive gripping with thumb and index finger. The inscription instrument can thereby be guided in the immediate vicinity of the sensing pin 24, permitting easy smooth sliding inscription. With this sensing pin the guide grooves in the pattern are traced. It is interchangeable for adaptation to various lettering sizes or pattern guide grooves.

The grip body 12 comprises a moulding which is adapted to the ball of the thumb under ergonometric aspects so that effortless operation without cramping of the hand or fingers is ensured. The upper boundary curve 62 rises initially from the tracing pin end in a relatively pronounced curvature which then flattens forwardly towards the clamping head 20. The lower portion 64 of the clamping body comprises a smaller wall thickness and defines a lower finger grip recess 66. The ring finger or the little finger of the hand guiding the inscription instrument can engage in said finger grip recess to enable the instrument to be lifted comfortably from the drawing surface.

Figure 2:
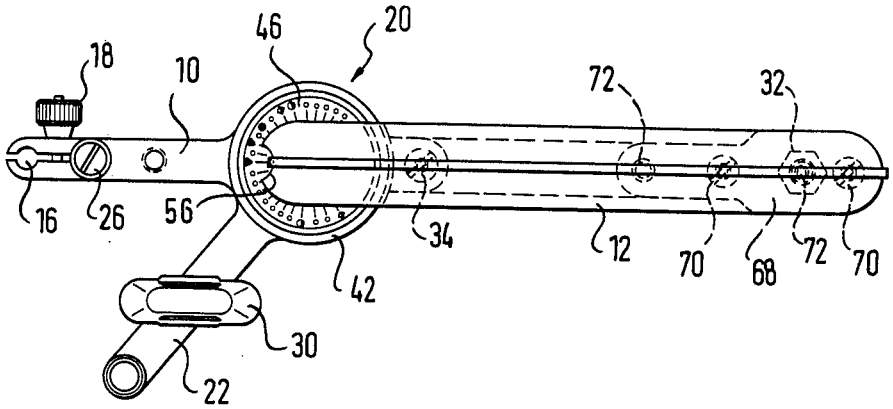
FIG. 2 is a plan view of the inscription instrument according to FIG. 1.
Figure 3:
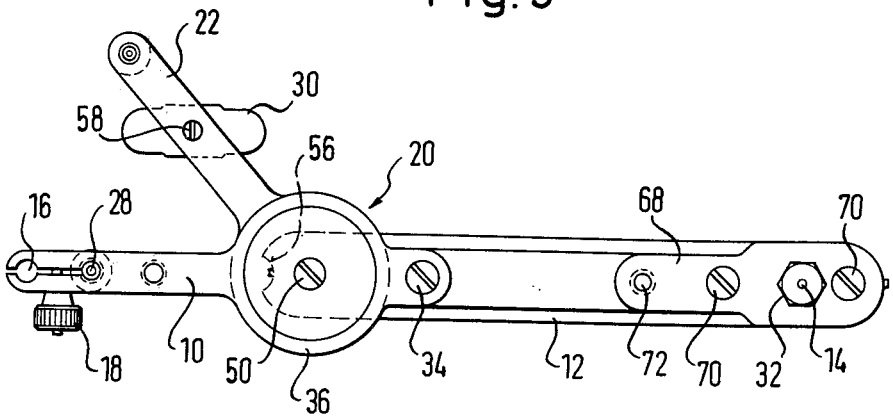
FIG. 3 is a view of the inscription instrument according to FIGS. 1 and 2 from below.

According to the embodiment of FIGS. 2 and 3 at the rear end of the grip body a metal plate 68 is secured with screws 70. Said plate carries threaded holes 42 into which the tracing pin can be selectively screwed with its hexagon nut 32.

Alternatively, as apparent from FIG. 1 one or more threaded bushings 74 may be molded into the grip body.

We claim:

1. An inscription instrument, comprising:

a writing arm; a writing implement supported on the writing arm; a tracing pin supported on the writing arm and which can be inserted into a guide groove for tracing the groove; the writing implement and tracing pin being spaced apart along the writing arm;

a sensing arm extending from the writing arm, the sensing arm being fixable at a plurality of relative positions with respect to the writing arm; a clamping head located at the writing arm and at the sensing arm for clamping the sensing arm at its various positions with respect to the writing arm; a sensing pin on the sensing arm for sensing characters, or the like, defined in a stencil, or the like;

the writing arm being formed as a grippable body between the clamping head and the tracing pin; the grippable body having an upwardly, convexly curved form adapted to the ball of a user's thumb; the convexly curved form including a more steeply curved portion curving down toward the tracing pin, a more flatly curved upper and front portion curving down toward the clamping head and corresponding to the form of the ball of a user's thumb, and a boundary curved portion between the two downwardly curving portions of the curved form; a finger grip recess at the lower side of the grip body;

a guide grip located on the sensing arm, the guide grip being generally flat in shape and being upstanding from the sensing arm and being rotatable on the sensing arm about an axis generally perpendicular to the direction of extension of the sensing arm.

2. The inscription instrument of claim 1, wherein the grip body has a thickness across the width thereof, and the grip body is thicker toward the outside of the convex curve thereof and is thinner toward the inside of the convex curve thereof.

3. The inscription instrument of claim 1, wherein the curve of the grip body is such that the grip body partially passes over the clamping head.

4. The inscription instrument of claim 1, wherein the guide grip is formed with finger recesses therein.

5. The inscription instrument of claim 1, wherein the writing arm is fixed to the grip body; a bore up into the writing arm; a threaded sleeve passing up through the bore; the sensing arm carrying a nut for cooperating with the threaded sleeve and by means of the nut, the sensing arm being fixable with respect to the writing arm.

6. The inscription instrument of claim 5, further comprising a scale carrier disc connected with the sleeve and non-rotatably connected to the sensing arm; window means in the grip body for permitting readout of the scale on the disc.

7. The inscription instrument of claim 6, further comprising a pin connected to the disc and a bearing bushing for the pin located in the grip body, whereby the disc may rotate around the pin thereof.

8. The inscription instrument of claim 1, further comprising plural holes along the grip body for receiving the tracing pin, thereby enabling selection of the length of the writing arm as measured between the tracing pin and the writing implement.

9. The inscription instrument of claim 8, wherein the holes in the grip body are threaded and the tracing pin is threadedly screwed into one of the holes.

10. The inscription instrument of claim 9, wherein the tracing pin has a profiled head by which the pin may be rotated to be screwed into the tracing pin receiving holes on the grip body.

* * * * *